US010378266B2

(12) United States Patent
Walden

(10) Patent No.: US 10,378,266 B2
(45) Date of Patent: Aug. 13, 2019

(54) REMOTE CONTROLLED RECESSED WINDOW

(71) Applicant: Terry Walden, Bloomington, IN (US)

(72) Inventor: Terry Walden, Bloomington, IN (US)

( * ) Notice: Subject to any disclaimer, the term of this patent is extended or adjusted under 35 U.S.C. 154(b) by 127 days.

(21) Appl. No.: 15/625,589

(22) Filed: Jun. 16, 2017

(65) Prior Publication Data

US 2017/0362871 A1 Dec. 21, 2017

Related U.S. Application Data

(60) Provisional application No. 62/350,800, filed on Jun. 16, 2016.

(51) Int. Cl.

| | |
|---|---|
| ***E05F 15/77*** | (2015.01) |
| ***E06B 3/46*** | (2006.01) |
| ***E06B 3/44*** | (2006.01) |
| ***G07C 9/00*** | (2006.01) |
| ***G08C 17/02*** | (2006.01) |
| *E05F 15/632* | (2015.01) |

(52) U.S. Cl.

CPC ..... *E05F 15/77* (2015.01); *E06B 3/4423* (2013.01); *E06B 3/4654* (2013.01); *G07C 9/00182* (2013.01); *G08C 17/02* (2013.01); *E05F 15/632* (2015.01); *E05Y 2900/148* (2013.01); *G08C 2201/30* (2013.01); *G08C 2201/93* (2013.01)

(58) Field of Classification Search

CPC .. E05F 15/77; E05F 15/665; E05Y 2900/148; E05B 65/08; E06B 3/4423; E06B 3/4654; G08C 17/02; G08C 2201/93; G07C 9/00182

See application file for complete search history.

(56) References Cited

U.S. PATENT DOCUMENTS

| | | | | |
|---|---|---|---|---|
| 2,979,328 | A * | 4/1961 | Henrikson | E05F 15/665 49/361 |
| 3,235,247 | A * | 2/1966 | Tolson | E05F 15/63 49/103 |
| 3,469,345 | A * | 9/1969 | Hanks | E05F 15/665 49/2 |
| 4,401,929 | A | 8/1983 | Odaka et al. | |
| 5,440,837 | A * | 8/1995 | Piltingsrud | E05D 15/22 49/139 |
| 5,449,987 | A | 9/1995 | McMillan | |
| 5,595,026 | A * | 1/1997 | Licking | E05B 51/02 49/280 |
| 5,782,036 | A | 7/1998 | Bertieri et al. | |

(Continued)

*Primary Examiner* — Justin B Rephann

(74) *Attorney, Agent, or Firm* — Global Intellectual Property Agency, LLC; Daniel Boudwin

(57) ABSTRACT

A remote controlled recessed window. The remote controlled recessed window includes a channel disposed within a wall, wherein a pair of opposing tracks are disposed within the channel. A pane having a first side and a second side is disposed within a frame. The first side and the second side are slidably engaged with the pair of opposing tracks. A motor is disposed within the channel and is operably connected to the pane such that the motor can slide the pane along the pair of opposing tracks between an open position and a closed position. A wireless receiver is in electrical communication with the motor. A wireless device can communicate with the wireless receiver to actuate the motor.

13 Claims, 5 Drawing Sheets

(56) References Cited

U.S. PATENT DOCUMENTS 6,581,332 B1 * 6/2003 Kim ..... E05F 15/77 49/358
6,674,255 B2 * 1/2004 Schnebly ..... E06B 9/32 318/16
6,918,210 B1 * 7/2005 Smiley ..... E05F 15/643 49/347
8,698,608 B2 4/2014 Nielsen et al.
2004/0163314 A1 * 8/2004 Lagarde ..... G08B 25/008 49/31
2004/0244295 A1 * 12/2004 Derham ..... E05F 15/41 49/362
2005/0034374 A1 * 2/2005 Ebbe ..... G07C 9/00309 49/325
2006/0150520 A1 * 7/2006 Hamazaki ..... E05B 65/08 49/449
2007/0011946 A1 1/2007 Mullen et al.
2010/0089388 A1 * 4/2010 Gunton ..... E05F 15/622 126/572
2010/0132260 A1 * 6/2010 Lee ..... E06B 9/264 49/70
2010/0270814 A1 * 10/2010 Labarre ..... E05B 47/0012 292/144
2012/0023827 A1 * 2/2012 Hancock ..... E05F 15/635 49/360
2012/0192490 A1 * 8/2012 McCaslin ..... H04L 12/2827 49/31
2013/0318875 A1 * 12/2013 Hansen ..... E05F 15/665 49/349
2014/0047768 A1 * 2/2014 Vaknin ..... E05D 15/06 49/25
2014/0167927 A1 6/2014 Rush
2016/0047158 A1 * 2/2016 Raap ..... E06B 3/44 49/31
2017/0191299 A1 * 7/2017 Hariprasad ..... E06B 3/4415
2018/0023333 A1 * 1/2018 Lange ..... E05D 13/006 49/349
2018/0238097 A1 * 8/2018 Plummer ..... E05F 15/603

* cited by examiner

REMOTE CONTROLLED RECESSED WINDOW

CROSS REFERENCE TO RELATED APPLICATIONS

This application claims the benefit of U.S. Provisional Application No. 62/350,800 filed on Jun. 16, 2016. The above identified patent application is herein incorporated by reference in its entirety to provide continuity of disclosure.

BACKGROUND OF THE INVENTION

The present invention relates to recessed windows. Specifically, it relates to recessed windows that can be opened and closed remotely.

Many homes have windows that are difficult to open for a variety of reasons, such as the weight of the window, the window expanding due to heat, or the window otherwise being stuck due to age. Frequently, these windows pose a problem for the elderly or those lacking the requisite upper body strength to open these windows. Additionally, manually opening each window in a home can be time consuming and inconvenient. Therefore, a window that can be opened and closed remotely is needed.

In light of the devices disclosed in the known art, it is submitted that the present invention substantially diverges in design elements from the known art and consequently it is clear that there is a need in the art for an improvement to existing recessed windows. In this regard, the instant invention substantially fulfills these needs.

SUMMARY OF THE INVENTION

In view of the foregoing disadvantages inherent in the known types of recessed windows now present in the prior art, the present invention provides a recessed window wherein the same can be utilized for providing convenience for the user when opening and closing a recessed window at a distance.

The present system comprises a channel disposed within a wall, wherein a pair of opposing tracks are disposed within the channel. A pane is disposed within a frame, the pane having a first side and a second side. The first and second sides are slidably engaged with the pair of opposing tracks. A motor is disposed within the channel and is operably connected to the pane such that the motor is configured to slide the pane along the pair of opposing tracks between an open position and a second position. A wireless receiver is in electrical communication with the motor. A wireless device is configured to communicate with the wireless receiver to actuate the motor. In some embodiments, the motor is configured to slide the pane along the pair of opposing tracks between a plurality of positions, wherein each adjacent position increases the distance between a lateral side of the pane and an edge of the frame at intervals. In another embodiment, the wireless device is affixed to the wall adjacent to the frame. In other embodiments, the wireless device comprises a mobile computing device. In yet another embodiment, the pair of opposing tracks are disposed vertically within the channel. In some embodiments, the pair of opposing tracks are disposed horizontally within the channel. In another embodiment, an engagement member is disposed within the pair of opposing tracks, wherein the engagement member is configured to move between an engaged position and a disengaged position when actuated. In other embodiments, the engagement member is configured to engage with the pane via friction fit when in the engaged position. In yet another embodiment, the engagement member is configured to engage with an aperture within the pane when in the engaged position. In some embodiments, the wireless device is configured to communicate with the wireless receiver to actuate the engagement member. In another embodiment, the wireless device comprises an open control and a close control, wherein the open control is configured to send a signal to the wireless receiver to move the pane to the open position when actuated, and the close control is configured to send a signal to the wireless receiver to move the pane to the closed position when actuated. In other embodiments, the wireless device further comprises a lock control configured to send a signal to the wireless receiver to actuate the engagement member when the lock control is actuated.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
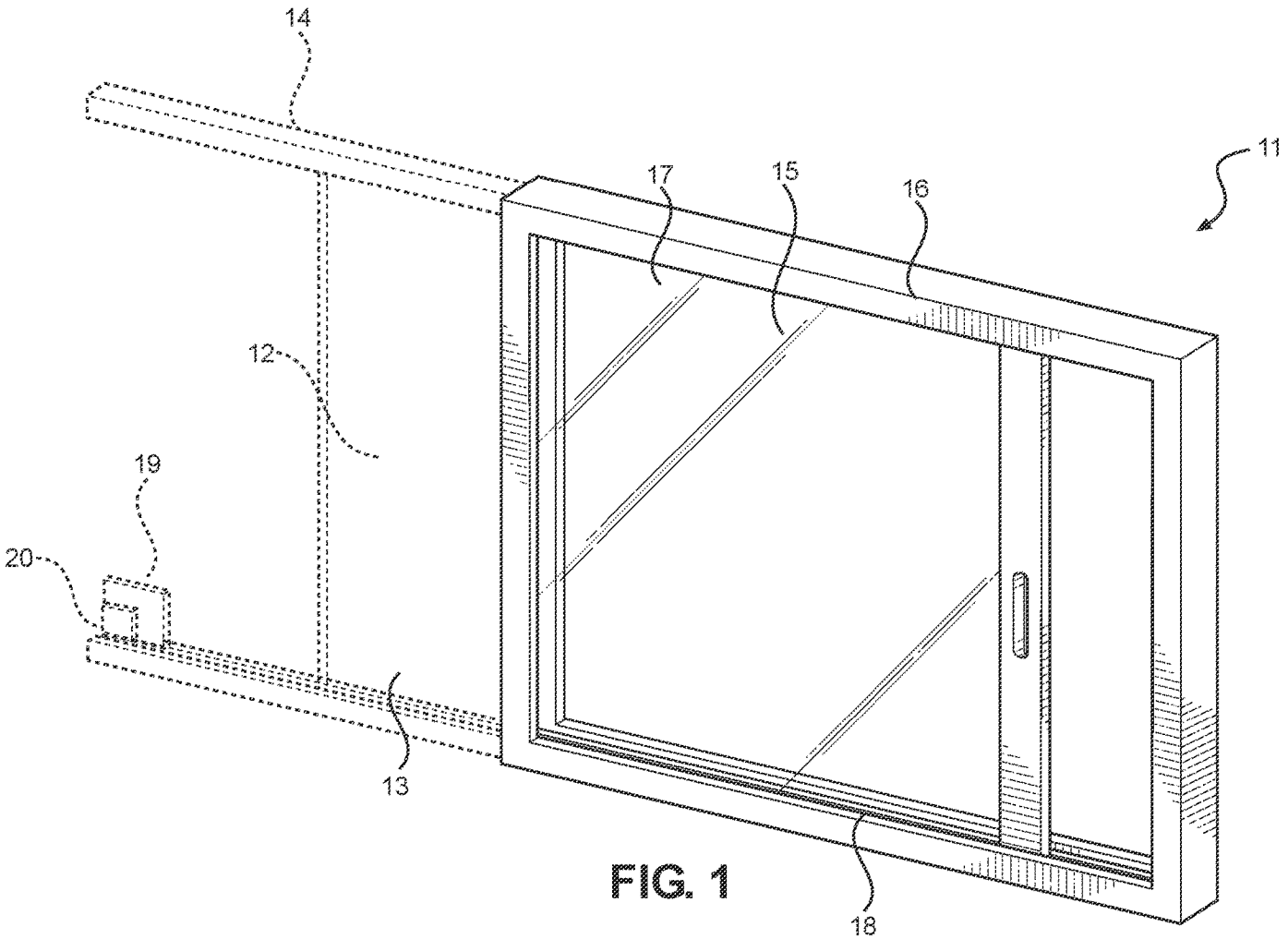
FIG. 1 shows a perspective view of an embodiment of the remote controlled recessed window.

Reference is made herein to the attached drawings. Like reference numerals are used throughout the drawings to depict like or similar elements of the recessed window. The figures are intended for representative purposes only and should not be considered to be limiting in any respect.

Figure 2:
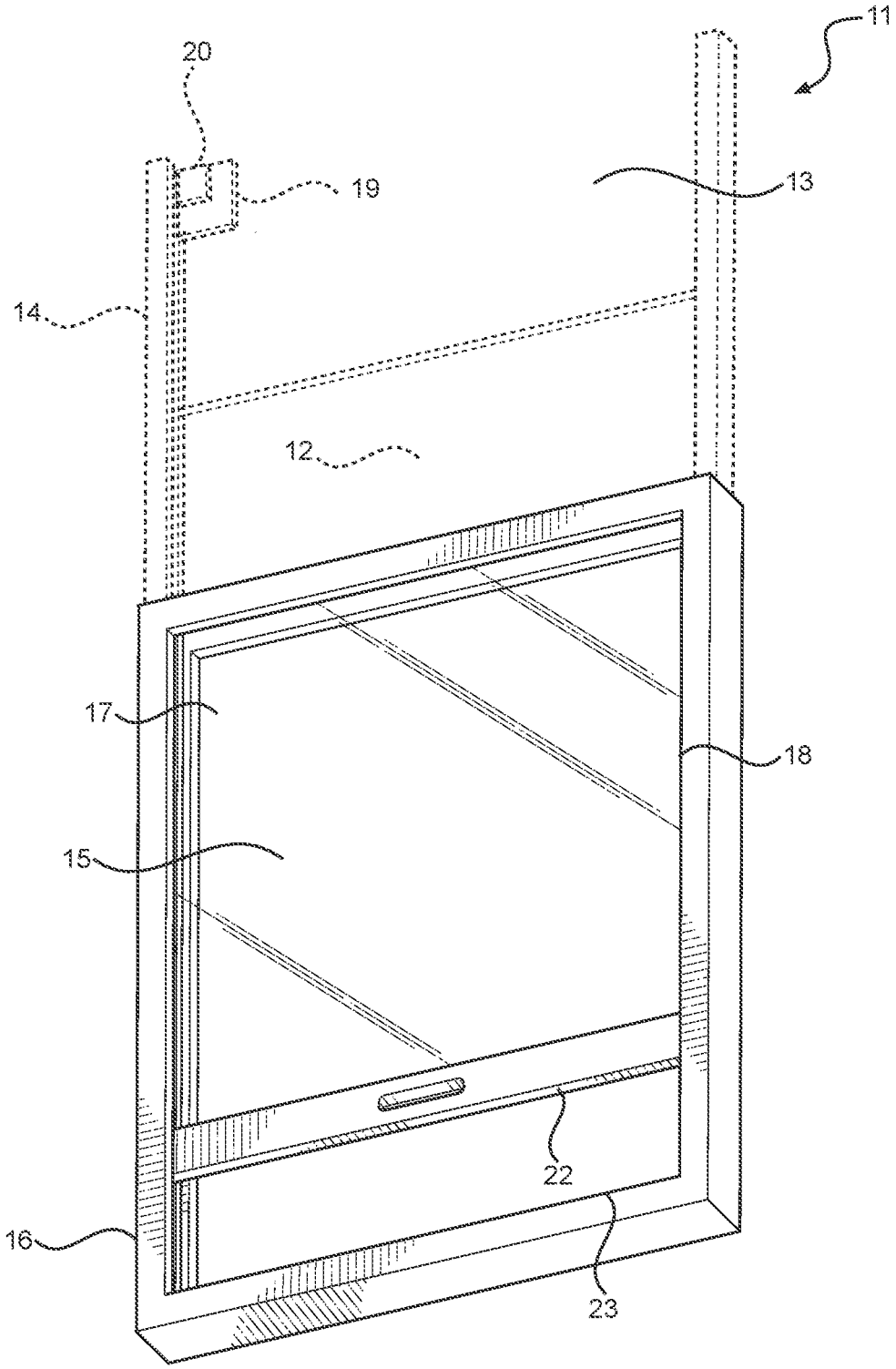
FIG. 2 shows a perspective view of an alternate embodiment of the remote controlled recessed window.

Referring now to FIGS. 1 and 2, there is shown a perspective view of an embodiment of the remote controlled recessed window and a perspective view of an alternate embodiment of the remote controlled recessed window, respectively. The remote controlled recessed window 11 comprises a pane 15 disposed within a frame 16. The frame 16 is configured to be disposed within a wall 13. The pane 15 comprises a translucent material to allow a user to see through the pane 15. In the illustrated embodiment, a pair of opposing tracks 14 are disposed within the frame 16 extending into a channel 12 of the wall 13. A first side 17 of the pane 15 and a second side 18 of the pane 15 are slidably engaged with each of the pair of opposing tracks 14 respectively. The channel 12 is configured to receive the pane 15 therein. In some embodiments, the pair of opposing tracks 14 extend outward from opposing ends of the frame 16 and are adapted to be installed within the channel 12. In another embodiment, the pair of opposing tracks 14 extend the length of the frame 16, such that the pane 15 slides therein. In this way, the frame 16 can be installed in the wall 13 having no channel 12 therein. In the illustrated embodiment of FIG. 1, the pair of opposing tracks 14 are disposed horizontally within the channel 12, while in the illustrated embodiment of FIG. 2, the pair of opposing tracks 14 are disposed vertically. In this way, the pane 15 can slide vertically or horizontally as the design of the remote controlled recessed window 11 requires. In another embodiment, the remote controlled recessed window 11 further comprises a shield slidably engaged with the pair of opposing tracks 14 on an exterior side of the pane 15, wherein the shield is configured to cover and protect the pane 15 when in a closed position. The shield serves to prevent damage to the pane 15 from debris or other impacts, such as those that would occur during a hurricane.

The remote controlled recessed window 11 further comprises a motor 19, wherein the motor 19 is adapted to be disposed within the channel 12. In some embodiments, the motor 19 is disposed within the channel 12. The motor 19 is operably connected to the pane 15, such that when the motor 19 is actuated, the pane 15 slides along the pair of opposing tracks 14 between an open position and a closed position. In the closed position, the pane 15 rests within the frame 16 outside of the channel 12. In the open position, the pane 15 rests within the channel 12. In the illustrated embodiment, the motor 19 further comprises a wireless receiver 20 in electrical communication with the motor 19, wherein the wireless receiver 20 is configured to receive a signal to actuate the motor 19.

In some embodiments, the motor 19 is configured to slide the pane 15 along the pair of opposing tracks 14 between a plurality of positions when the motor 19 is actuated such that each adjacent position increases the distance between a lateral side 22 of the pane 15 and an edge 23 of the frame 16 in predetermined intervals. In some embodiments, each interval is equivalent to a quarter of the length of the pane along the longitudinal axis thereof. Each actuation of the motor 19 causes the pane 15 to slide to an adjacent position. In this way, a user can partially open or close the remote controlled recessed window 11.

Figure 3A:
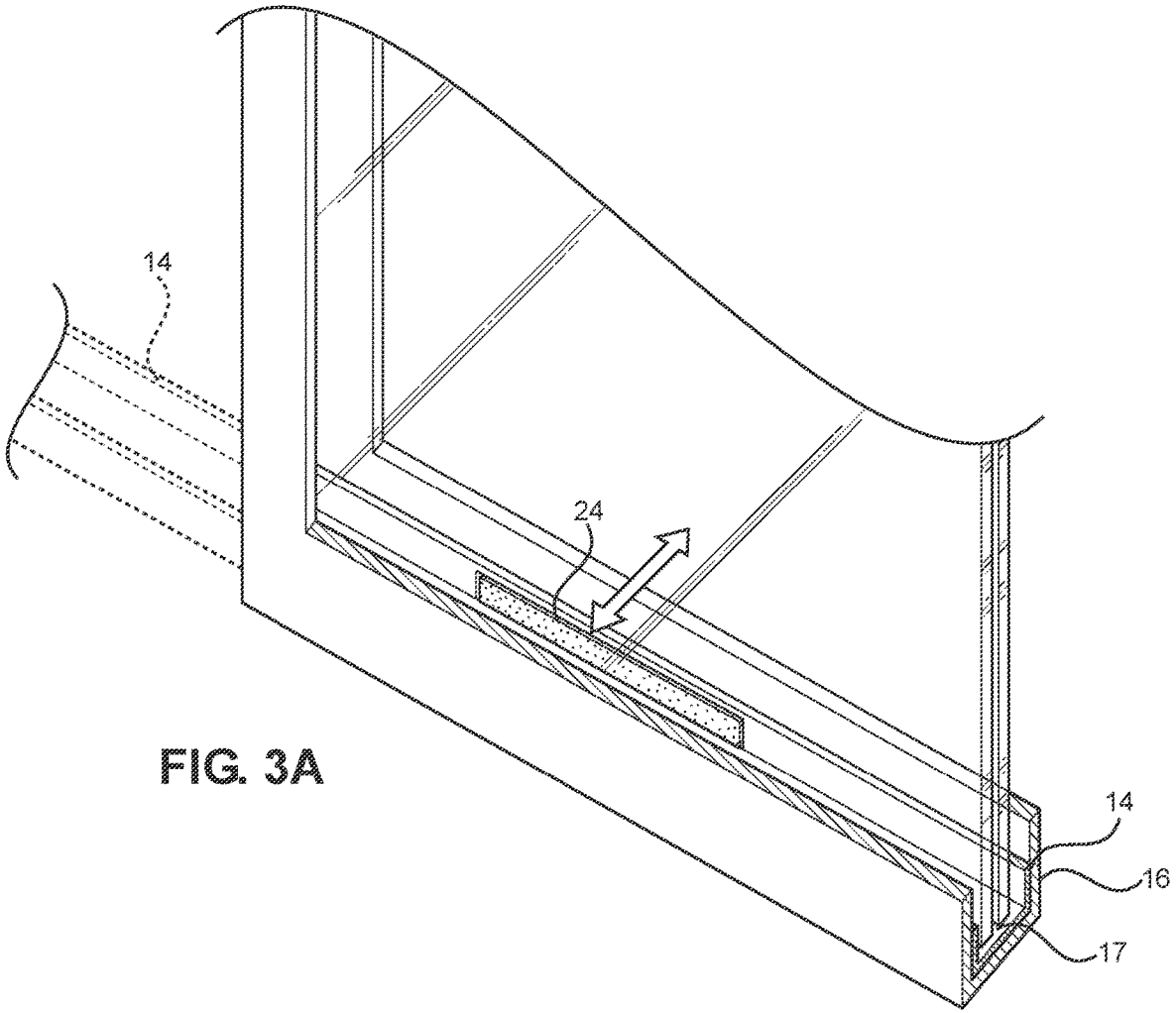
FIG. 3A shows a perspective view of an embodiment of the engagement member of the remote controlled recessed window.

Referring now to FIG. 3A, there is shown a perspective view of an embodiment of the engagement member of the remote controlled recessed window. In some embodiments, the pair of opposing tracks 14 further comprise an engagement member 24. The engagement member 24 is configured to move between an engaged position and a disengaged position when actuated. In the engaged position, the engagement member 24 engages the first side 17 such that the pane can no long slide along the pair of opposing tracks 14. In this way, the position of the pane can be locked such that the pane cannot slide along the pair of opposing tracks 14. In some embodiments, the motor is operably connected to the engagement member 24 such that it is configured to actuate the engagement member 24 when the motor is actuated, such as on receipt of a signal by the wireless receiver. In the illustrated embodiment, the engagement member 24 comprises a pair of rectangular pads extending along the longitudinal axis of the pair of opposing tracks 14. The pair of rectangular pads are configured extend from the pair of opposing tracks 14 to friction fit the pane in place when in the engaged position. The pair of rectangular pads are then retracted to disengage from the pane when in the disengagement position.

Figure 3B:
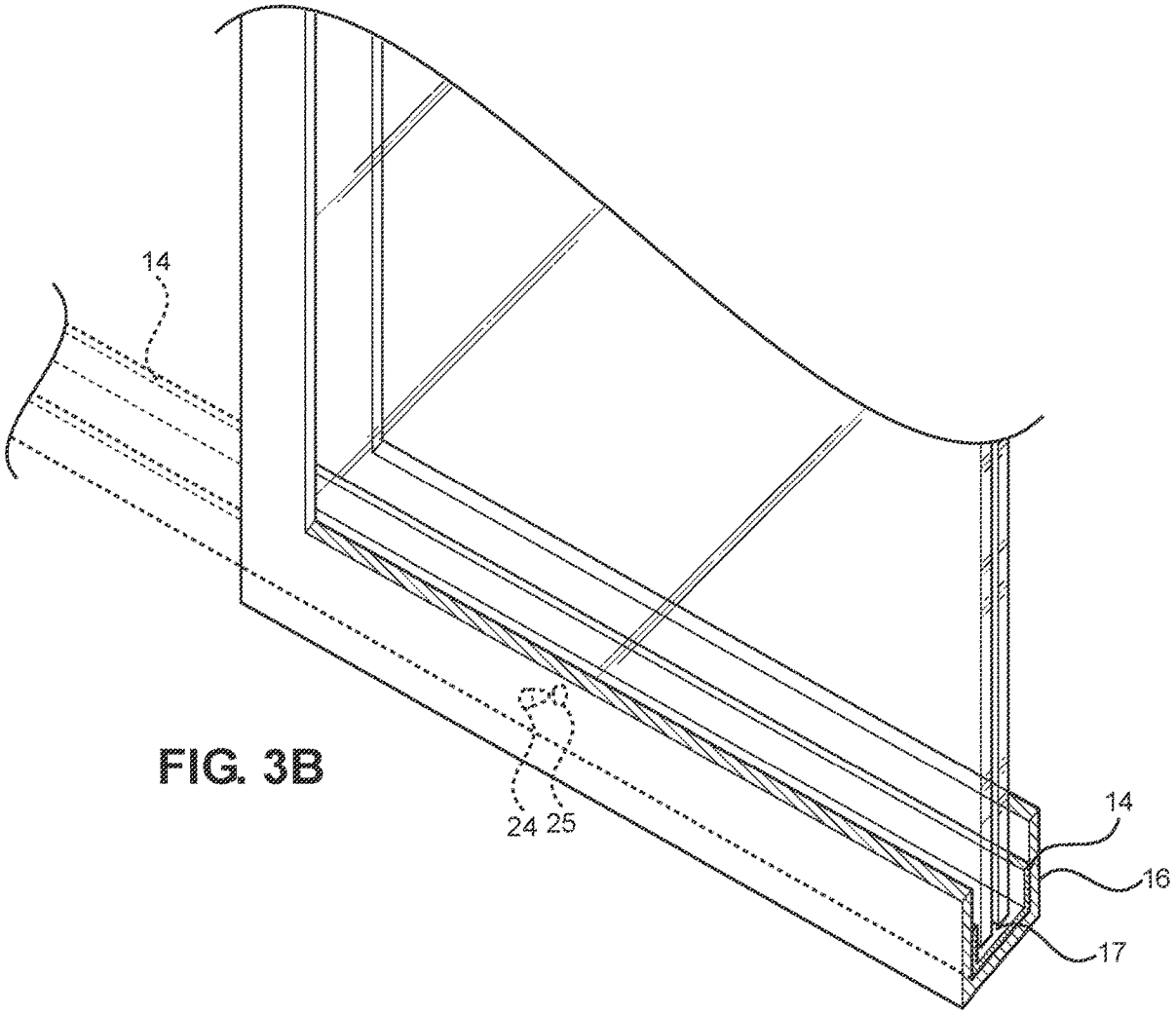
FIG. 3B shows a perspective view of an alternate embodiment of the engagement member of the remote controlled recessed window.

Referring now to FIG. 3B, there is shown a perspective view of an alternate embodiment of the engagement member of the remote controlled recessed window. In the illustrated embodiment, the engagement member 24 comprises a pin configured to move between an engaged position and a disengaged position, wherein the engagement member 24 extends to engage with an aperture 25 disposed within the first side 17 when in the engaged position. When in the disengagement position, the pin is retracted to disengage from the aperture 25. In this way, the pane is prevented from sliding along the pair of opposing tracks 14.

Figure 4:
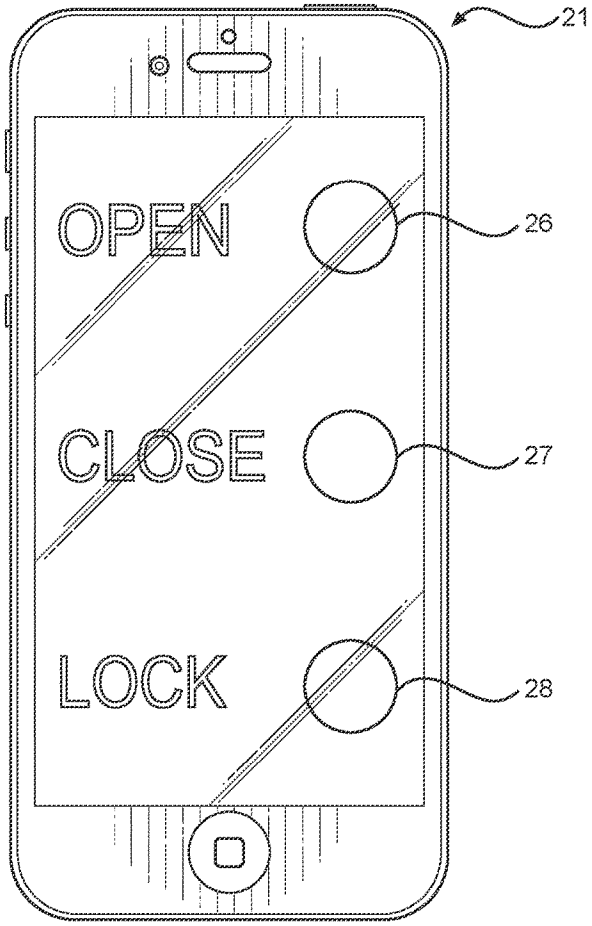
FIG. 4 shows a perspective view of an embodiment of the wireless device of the remote controlled recessed window.

Referring now to FIG. 4, there is shown a perspective view of an embodiment of the wireless device. The remote controlled recessed window further comprises a wireless device 21 configured to communicate with the wireless receiver to actuate the motor. In the illustrated embodiment, the wireless device 21 comprises an open control 26, a close control 27, and a lock control 28, wherein each control is configured to send a corresponding signal to the wireless receiver to actuate the motor. When the open control 26 is actuated, the wireless device 21 sends a signal to slide the pane towards the open position. When the close control 27 is actuated, the wireless device 21 sends a signal to slide the pane towards the closed position. When the lock control 28 is actuated, the wireless device 21 sends a signal to toggle the engagement member between the engaged and disengaged positions. In the illustrated embodiment, the wireless device 21 comprises a mobile computing device, such as a smartphone or tablet, however in alternate embodiments, the wireless device 21 comprises any remote-control device. In another embodiment, the wireless device 21 is affixed to the wall adjacent to the remote controlled recessed window.

Referring to FIGS. 1-5, in one use, the user actuates a control on the wireless device 21 relative to the desired position of the pane 15. Should the user wish to move the pane 15 to an open position, the user actuates the open control 26. The wireless device 21 then sends a signal to the wireless receiver 20 to actuate the motor 19. The motor 19 then slides the pane 15 along the pair of opposing tracks 14 into the channel 12 towards the open position. In some embodiments, one actuation of the open control 26 would result in the pane 15 sliding a set interval along the pair of opposing tracks 14, such that the distance between the lateral side 22 and the edge 23 increases. When the user desires the pane 15 to move to the closed position, the user actuates the close control 27 on the wireless device 21. The wireless device 21 then sends a signal to the wireless receiver 20 which in turn actuates the motor 19 to slide the pane 15 along the pair of opposing tracks 14 out of the channel 12 towards the closed position. If the user desires the pane 15 to be locked in position, the user would actuate the lock control 28 which moves the engagement member 24 to the engaged position, preventing the pane 15 from sliding along the pair of opposing tracks 14. In some embodiments, the engagement member 24 engages with the aperture 25 to lock the pane 15 in place.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A remote controlled recessed window, comprising:

a channel disposed within a wall;

a pair of opposing tracks disposed within a frame;

wherein the pair of opposing tracks extend outward from opposing ends of the frame into the channel of the wall;

a pane disposed within the frame, the pane having a first side and a second side;

wherein the first side and the second side slidably engage with the pair of opposing tracks;

an engagement member disposed within the pair of opposing tracks configured to move between an engaged position and a disengaged position when actuated;

wherein the engagement member is configured to engage with the pane via friction fit when in the engaged position;

a motor disposed within the channel operably connected to the pane;

wherein the motor is configured to slide the pane along the pair of opposing tracks between an open position and a closed position;

a wireless receiver in electrical communication with the motor; and a wireless device configured to communicate with the wireless receiver to actuate the motor.

2. The remote controlled recessed window of claim 1, wherein the motor is configured to slide the pane along the pair of opposing tracks between a plurality of positions wherein each adjacent position increases the distance between a lateral side of the pane and an edge of the frame at intervals.

3. The remote controlled recessed window of claim 1, wherein the wireless device is affixed to the wall adjacent to the frame.

4. The remote controlled recessed window of claim 1, wherein the wireless device comprises a mobile computing device.

5. The remote controlled recessed window of claim 1, wherein the pair of opposing tracks are disposed vertically within the channel.

6. The remote controlled recessed window of claim 1, wherein the pair of opposing tracks are disposed horizontally within the channel.

7. The remote controlled recessed window of claim 1, wherein the engagement member is configured to engage with an aperture within the pane when in the engaged position.

8. The remote controlled recessed window of claim 1, wherein the wireless device is configured to communicate with the wireless receiver to actuate the engagement member.

9. The remote controlled recessed window of claim 1, wherein the wireless device comprises an open control and a close control, wherein the open control is configured to send a signal to the wireless receiver to move the pane to the open position when actuated, and the close control is configured to send a signal to the wireless receiver to move the pane to the closed position when actuated.

10. The remote controlled recessed window of claim 9, wherein the wireless device further comprises a lock control configured to send a signal to the wireless receiver to actuate the engagement member when the lock control is actuated.

11. The remote controlled recessed window of claim 9, wherein the open control and the close control are configured to move the pane in predetermined intervals.

12. The remote controlled recessed window of claim 11, wherein the predetermined intervals comprise one quarter the length of the pane along the longitudinal axis thereof.

13. The remote controlled recessed window of claim 1, further comprising a shield slidably engaged with the pair of opposing tracks on an exterior side of the pane, wherein the shield is configured to cover and protect the pane when in a closed position.

* * * * *